US007364099B2

(12) United States Patent
Boecking

(10) Patent No.: US 7,364,099 B2
(45) Date of Patent: Apr. 29, 2008

(54) FUEL INJECTION DEVICE FOR AN INTERNAL COMBUSTION ENGINE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 288 days.

(21) Appl. No.: 10/527,585

(22) PCT Filed: Jul. 23, 2003

(86) PCT No.: PCT/DE03/02462

§ 371 (c)(1),
(2), (4) Date: Mar. 14, 2005

(87) PCT Pub. No.: WO2004/036026

PCT Pub. Date: Apr. 29, 2004

(65) Prior Publication Data

US 2006/0102752 A1 May 18, 2006

(30) Foreign Application Priority Data

Oct. 15, 2002 (DE) ..... 102 47 958

(51) Int. Cl.
*F02M 61/00* (2006.01)
*F02M 47/02* (2006.01)

(52) U.S. Cl. ..... 239/533.12; 239/533.3; 239/91; 239/533.2

(58) Field of Classification Search ..... 239/5, 239/418, 433, 533.12, 533.3–533.9, 533.11, 239/583, 584, 585.1–585.5, 543, 544; 123/294, 123/296, 299, 305
See application file for complete search history.

(56) References Cited

U.S. PATENT DOCUMENTS

| | | | | |
|---|---|---|---|---|
| 4,083,498 | A * | 4/1978 | Cavanagh et al. | 239/533.3 |
| 4,758,169 | A * | 7/1988 | Steiger | 239/96 |
| 6,055,957 | A * | 5/2000 | Hasegawa et al. | 123/305 |
| 6,220,528 | B1 * | 4/2001 | Cooke et al. | 239/533.3 |
| 6,467,702 | B1 * | 10/2002 | Lambert et al. | 239/533.12 |
| 6,565,017 | B1 * | 5/2003 | Fath et al. | 239/533.3 |
| 6,758,407 | B1 * | 7/2004 | Lambert et al. | 239/5 |
| 6,764,027 | B2 * | 7/2004 | Dantes et al. | 239/533.12 |
| 2002/0179743 | A1 | 12/2002 | Haeberer et al. | |

FOREIGN PATENT DOCUMENTS

| | | | |
|---|---|---|---|
| DE | 38 24 467 | A | 1/1990 |
| DE | 38 24 467 | A1 | 1/1990 |
| DE | 44 32 686 | A | 5/1996 |
| DE | 44 32 686 | A1 | 5/1996 |
| DE | 198 43 616 | A | 3/2000 |
| DE | 198 43 616 | A1 | 3/2000 |
| DE | 100 20 148 | A | 11/2000 |
| DE | 100 20 148 | A1 | 11/2000 |
| DE | 199 42 370 | A | 3/2001 |
| DE | 199 42 370 | A1 | 3/2001 |
| DE | 101 55 227 | A | 5/2003 |
| DE | 101 55 227 | A1 | 5/2003 |
| EP | 0 067 143 | A | 12/1982 |
| EP | 0 067 143 | A1 | 12/1982 |
| EP | 1 063 416 | A | 12/2000 |
| EP | 1 063 416 | A2 | 12/2000 |
| EP | 1 198 672 | A | 4/2002 |
| GB | 2 266 559 | A | 11/1993 |
| JP | 4-86373 | | 3/1992 |
| JP | 040 86 373 | | 3/1992 |
| JP | 2001317433 | A * | 11/2001 |
| WO | WO 02/01066 | A1 | 1/2002 |

* cited by examiner

*Primary Examiner*—Dinh Q. Nguyen
*Assistant Examiner*—James S. Hogan
(74) *Attorney, Agent, or Firm*—Ronald E. Greigg

(57) ABSTRACT

A fuel injection device for an internal combustion engine includes a housing and at least one valve element which cooperates with a valve seat on an injection end of the housing. A plurality of fuel outlet conduits in the housing are associated with the valve element. In the region of the beginning of the fuel outlet conduits a flow chamber is present which is formed by at least one annular groove that is concentric with the longitudinal axis of the valve element.

20 Claims, 6 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 03/02462 filed on Jul. 23, 2003.

BACKGROUND OF THE INVENTION

1. Field of the Invention

The invention relates to a fuel injection device for an internal combustion engine, having a housing, and having at least one valve element, which cooperates with a valve seat on an injection end of the housing and with which at least two fuel outlet conduits in the housing are associated.

2. Description of the Prior Art

German Patent Disclosure DE 40 23 223 A1 discloses an injector with two coaxial valve needles which are each pressed against a valve seat by a helical compression spring. They are pressed away from the valve seat counter to the action force of the helical compression springs when the pressure of the fuel in the region of the valve seat is increased.

The fuel outlet openings in the inner valve element are disposed downstream of the valve seat and begin at a blind hole. The inner valve element accordingly cooperates with a "blind-hole nozzle". The outer valve element has its seat in the immediate vicinity of the fuel outlet opening. It is known as a "sacless (vco) nozzle".

OBJECTS AND SUMMARY OF THE INVENTION

The object of the present invention is to further develop a fuel injection device of the type defined at the outset in such a way that the fuel distribution to the individual injection ports is as symmetrical as possible, and the exhaust gas behavior of the engine is improved.

This object is attained, in a fuel injection device of the type defined at the outset, in that the fuel outlet conduits (68) associated with a valve element (36) communicate fluidically with one another through an annular groove (66).

In the fuel injection device of the invention, the advantages of blind-hole nozzles are attainable even with fuel outlet conduits disposed at arbitrary points in the fuel injection device. Until now, blind-hole nozzles were limited to an embodiment with a central blind hole in the housing of the fuel injection device. However, since an annular groove can be placed at nearly any arbitrary point, markedly greater freedom in positioning the fuel outlet conduits is now obtained.

Moreover, while on the one hand the advantages of a blind-hole nozzle can be attained at arbitrary fuel outlet conduits in the fuel injection device of the invention, at the same time the disadvantages of blind-hole nozzles are also reduced, since the flow space can be kept comparatively small, depending on the cross-sectional area of the annular groove.

By means of the annular groove, extremely symmetrical fuel distribution to the various fuel outlet conduits, which can be positioned arbitrarily, of a fuel injection device is made possible, and at the same time the emissions performance of the engine is improved.

In a first refinement, it is proposed that the annular groove is embodied in the housing. Because of the relatively great wall thickness of the housing anyway in the region of the injection end, such an annular groove does not lead to any sacrifices in terms of strength.

However, it is also possible for the annular groove to be embodied in the valve element. It can be made there relatively simply and economically, because of the good accessibility.

Finally, one annular groove can be embodied in the housing and a further annular groove can also be embodied in the valve element. In that case, a relatively large total cross section that joins the fuel outlet conduits to one another can be attained with only slight losses of strength at the same time.

If the annular groove has an approximately semicircular cross section, then it can be made simply. However, it can also have an asymmetrical cross section, with overall a lesser curvature upstream of the fuel outlet conduit than downstream. The result could for instance be a semi-teardrop-shaped cross section, which has advantages fluidically.

A fuel injection device that has at least two coaxial valve elements is especially preferred, in which the annular groove is present in the region of the fuel outlet conduits of the radially outer valve element, and the fuel outlet conduits of the radially inner valve element originate at a central blind hole which is embodied on the injection end of the housing.

In this kind of fuel injection device, in principle all the fuel outlet conduits accordingly have the properties of blind-hole nozzles. Only the radially inner valve element cooperates with a classical central blind bore, while conversely the radially outer valve element, because of the annular groove, has properties of a blind-hole nozzle.

BRIEF DESCRIPTION OF THE DRAWINGS

Other features and advantages of the invention are explained in detail below in conjunction with the accompanying drawings, in which.

DESCRIPTION OF THE PREFERRED EMBODIMENTS

Figure 1:
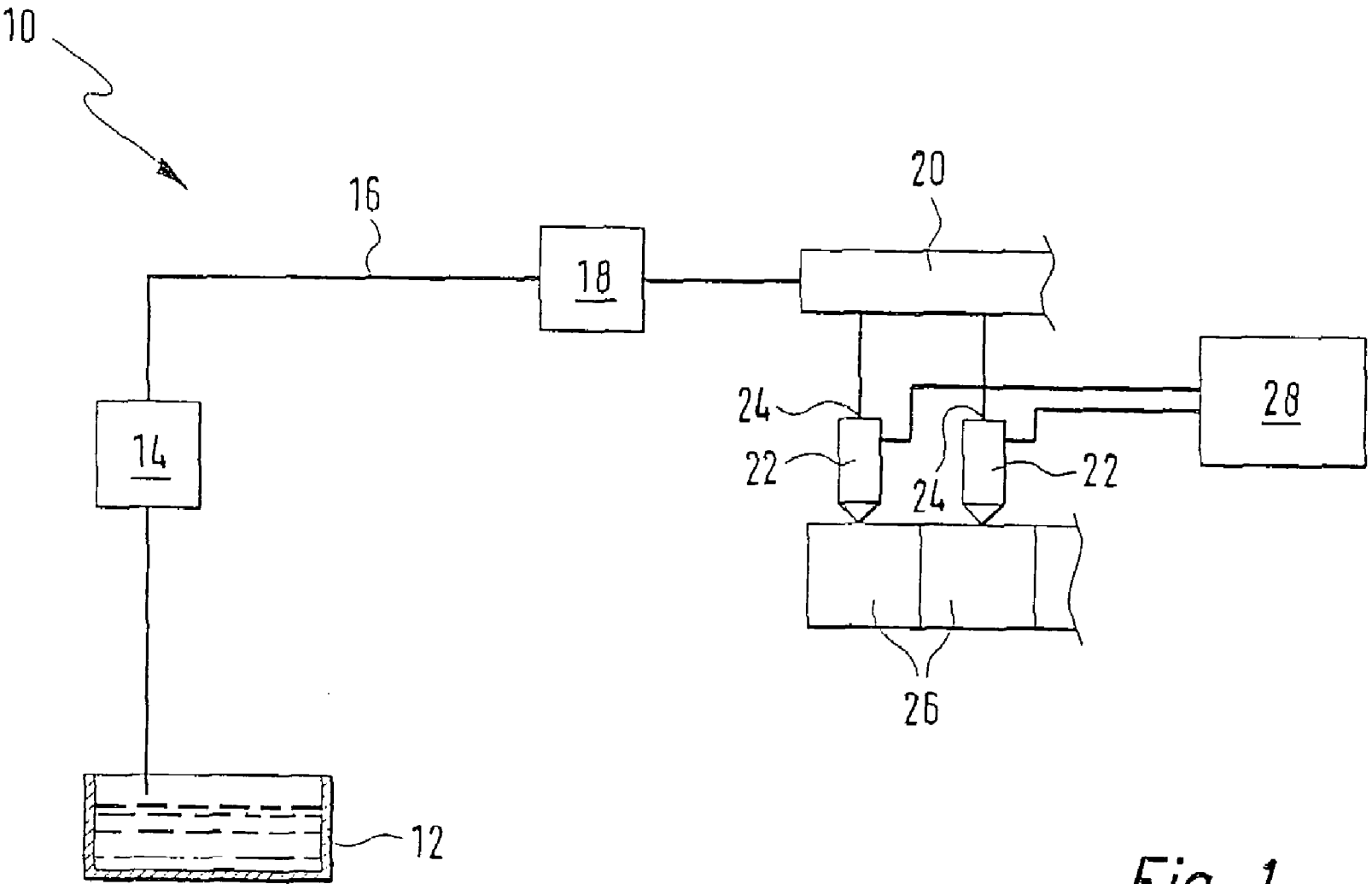
FIG. 1 is a schematic view of a fuel system of an internal combustion engine, with a plurality of fuel injection devices.

In FIG. 1, a fuel system of an internal combustion engine is identified overall by reference numeral 10. The engine itself is not shown further in detail.

The fuel system 10 includes a fuel tank 12, from which an electric low-pressure fuel pump 14 pumps the fuel into a low-pressure fuel line 16. This line leads to a high-pressure fuel pump 18. This pump is a piston pump, which is driven by a camshaft (not shown) of the engine. It compresses the fuel to a very high pressure and pumps it to a fuel collection line 20, in which the fuel is stored at high pressure.

A plurality of fuel injection devices 22 are connected to the fuel collection line 20. For this purpose, they have a high-pressure connection 24. The fuel injection devices 22 inject the fuel directly into respective combustion chambers 26 assigned to each of them. The operation of the engine in general and of the fuel system 10 and in particular the fuel injection devices 22 is controlled and regulated by a control and regulating unit 28.

The structure of one of the fuel injection devices 22 will now be explained in detail, referring to FIGS. 2 through 4. For the sake of simplicity, not all the reference numerals are entered in FIG. 2.

The fuel injection device 22 includes an elongated housing 30. In this housing, there is an elongated recess 32. In the recess, two valve elements 34 and 36 are disposed coaxially to one another. They are urged in the direction of the lower end, in FIG. 2, of the recess 32 by respective helical compression springs 38 and 40. The lower end of the housing 30, in FIG. 2, is identified by reference numeral 41 and will hereinafter also be called the "injection end", and it is shown in more detail in FIGS. 3 and 4.

Figure 2:
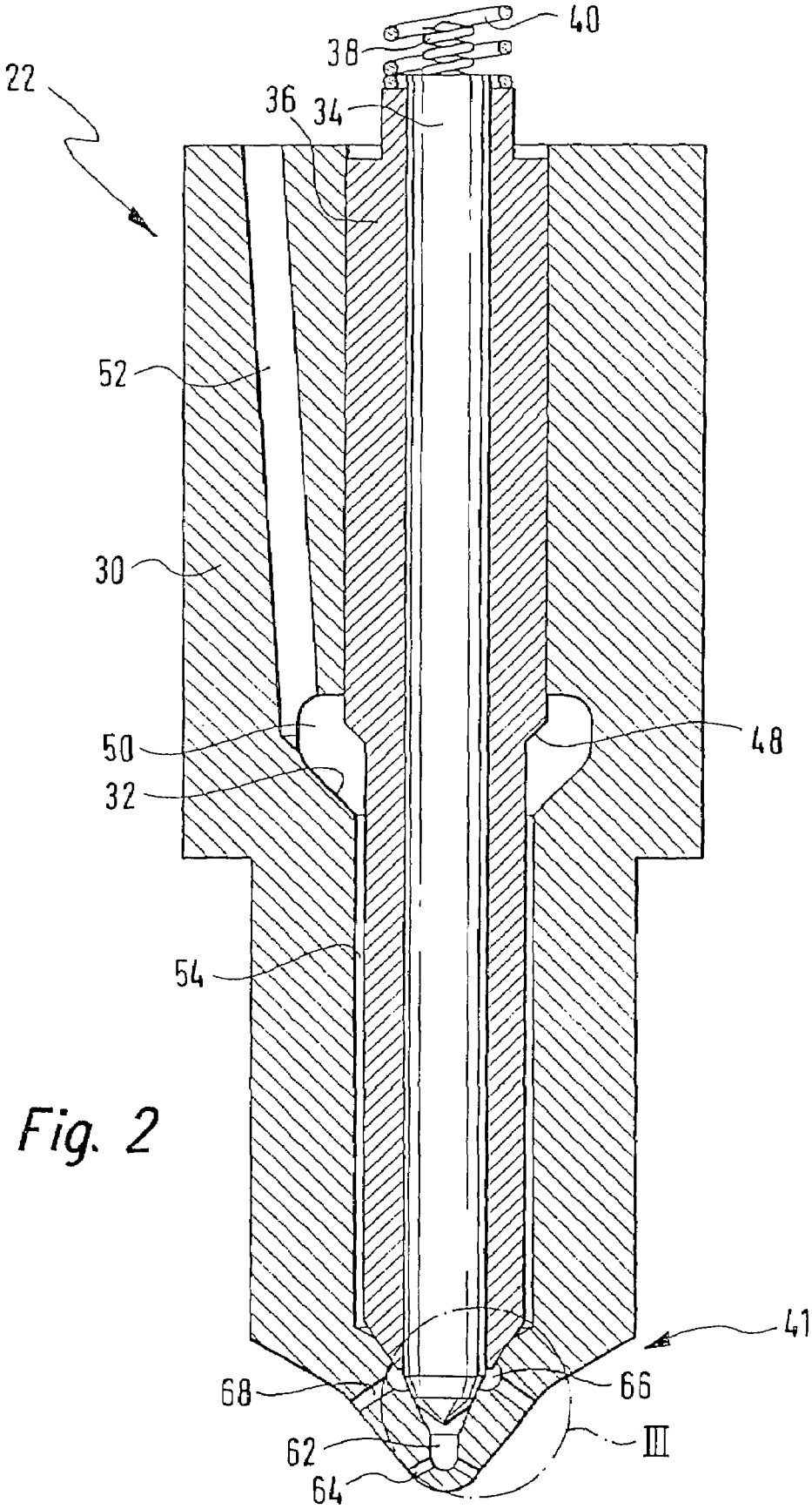
FIG. 2 is a fragmentary section through one of the fuel injection devices of FIG. 1.
Figure 3:
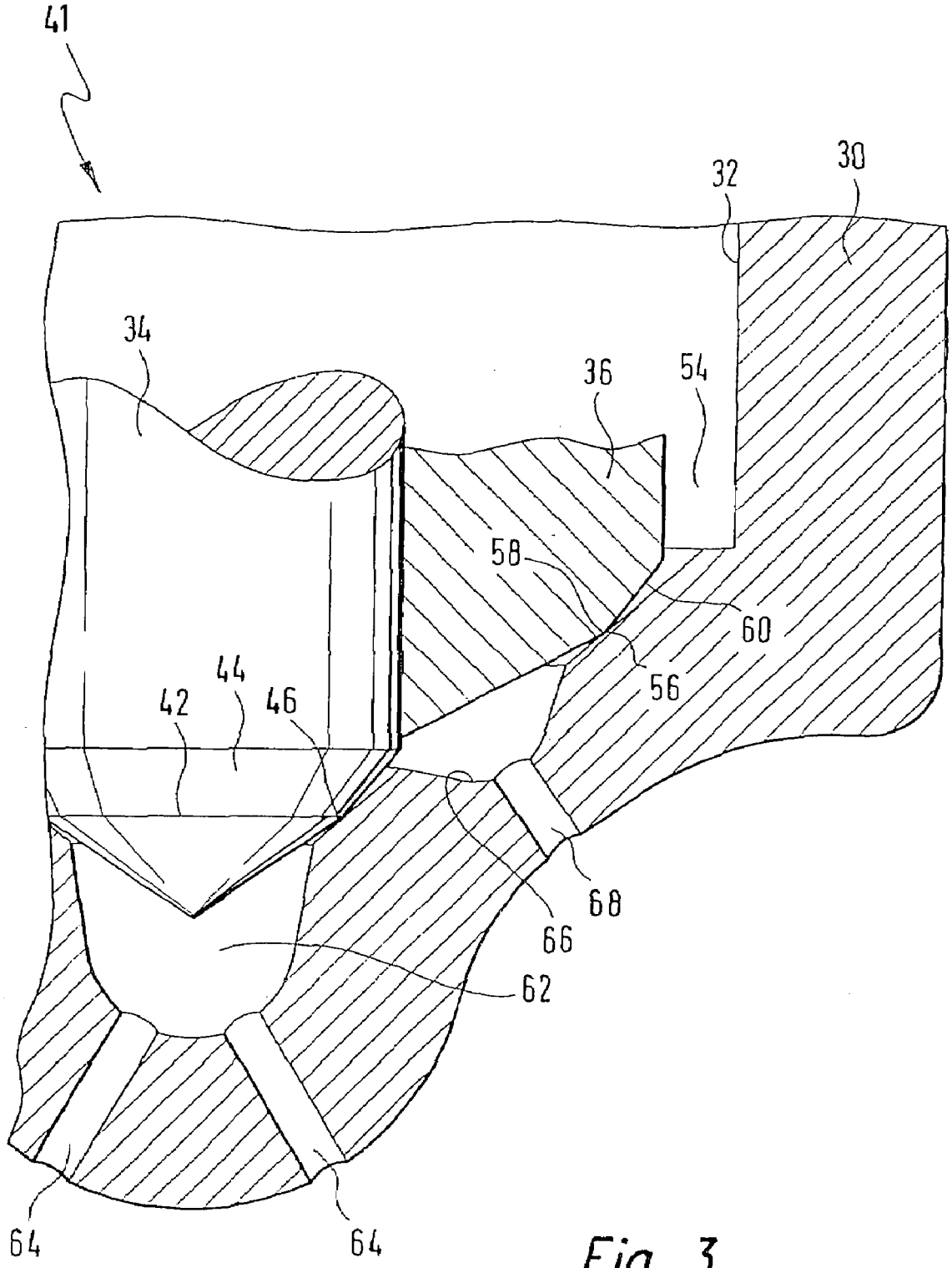
FIG. 3, a detail marked III of the fuel injection device of FIG. 2.

The inner valve element 34 tapers conically on its lower end, in terms of FIGS. 2 and 3. It has two regions of different conicity, between which a sealing edge 42 is formed. The region radially outward from the sealing edge 42 forms a pressure face 44, whose function will be addressed in greater detail hereinafter. The sealing edge 42 cooperates with a valve seat 46 in the housing.

The radially outer valve element 36 is tubular. On its outer jacket face, approximately at the level of its axial center, it has a conical shoulder, which forms a pressure face 48 (FIG. 2). In the region of the pressure face 48, there is an annular enlargement in the recess 32 that acts as a pressure chamber 50. This chamber communicates with the high-pressure connection 24 via a high-pressure conduit 52. Above the pressure chamber 50, the inside diameter of the recess 32 in the housing 30 is approximately equal to the outside diameter of the outer valve element 36. In this way, this valve element is guided in the housing 30 in a fluid-tight, sliding manner. Below the pressure chamber 50, the valve element 36 has a somewhat smaller outside diameter than the inside diameter of the recess 32. As a result, an annular flow conduit 54 is formed between the outer valve element 36 and the recess 32 and leads as far as the injection end 41.

The outer valve element 36 is guided in a sliding seat by the inner valve element 34. Its lower end, in terms of FIGS. 2 and 3, likewise tapers conically, with two regions of different conicity. Between these two regions of different conicity, there is a sealing edge 56, which analogously to the valve element cooperates with a valve seat 58. The conical region radially outside the sealing edge 56 again acts as a pressure face 60, whose function is explained hereinafter.

The recess 32 in the region of the injection end 41 ends in a central blind hole 62. From it, a plurality of fuel outlet conduits 64 extend radially outward. They are distributed uniformly over the circumference at the injection end 41 of the housing 30.

Between the valve seat 46 of the inner valve element 34 and the valve seat 58 of the outer valve element 36, an encompassing annular groove 66 that is concentric with the longitudinal axis of the recess 32 is made in the inner wall of the recess 32. It has a circular-segmental cross section. From the encompassing annular groove 66, a plurality of fuel outlet conduits 68 extend radially outward in a straight line from end to end, that is, from the end of each fuel outlet located at the annular groove 66 to the opposite end of each fuel outlet. They are likewise distributed over the circumference of the injection end 41 of the housing 30. The encompassing annular groove 66 can be seen especially clearly in FIG. 4, which shows the injection end 41 of the housing 30, leaving out the two valve elements 34 and 36.

The fuel injection device 22 shown in FIGS. 2 through 4 functions as follows: At low and medium load, it suffices if comparatively little fuel is injected by the fuel injection device 22 into the combustion chamber 26. In that case, the pressure in the fuel collection line 20 is regulated, in a manner of no further interest here, to a comparatively low level. If an injection is to occur, then by means of a control valve not shown in FIG. 1, the high-pressure connection 24 is made to communicate with the fuel collection line 20. As a result, the pressure in the pressure chamber 50 rises, and as a consequence also does so in the annular flow conduit 54. Thus the hydraulic force acting on the pressure face 60 increases.

The fuel pressure is selected to be so high that the hydraulic force engaging the pressure face 60 suffices to press the outer valve element 36 upward, counter to the action force of the helical compression spring 40, so that the sealing edge 56 lifts from the valve seat 58. As a result, fuel can enter the encompassing annular groove 66 and from there, via the fuel outlet conduits 68, it can reach the combustion chamber 26 assigned to the fuel injection device 22. The pressure in the fuel collection line 20, however, is selected to be only high enough that the hydraulic force, engaging the pressure face 48 of the inner valve element 34 when the valve element 36 is open, does not suffice to lift the inner valve element 34 from the valve seat 46.

In an exemplary embodiment not shown, the valve element 36 may communicate with a control chamber, which is defined by a pressure face whose force resultant acts in the closing direction. When the pressure in the control chamber is briefly lowered, the valve element 36, because of the high pressure that continues to be applied to the face 60, is lifted, so that fuel can flow out.

By means of the encompassing annular groove 66, the favorable properties of a blind-hole nozzle are realized: In particular, the communication among the individual fuel outlet conduits 68 distributed over the circumference makes the resulting injection pattern relatively uniform.

At high loads on the engine, an injection of fuel should take place on the one hand through the fuel outlet conduits 68 and on the other, additionally, through the fuel outlet conduits 64. To that end, the pressure in the fuel collection line 20 is increased, which with the control valve open is expressed by a corresponding increase in the pressure in the pressure chamber 50, in the annular flow conduit 54, and at the pressure faces 60 and 48 of the valve elements 36 and 34, respectively. The pressure now is selected to be high enough that the hydraulic force engaging the pressure face 48 of the valve element 34 suffices to lift the valve element 34 from the valve seat 46, counter to the action force of the helical compression spring 38. Through the gap that now results between the sealing edge 42 and the valve seat 46, the fuel can flow into the central blind hole 62 and from there can emerge via the fuel outlet conduits 64 into the combustion chamber 26. At the same time, fuel naturally also flows out into the combustion chamber 26 via the encompassing annular groove 66 and the fuel outlet conduits 68.

Figure 4:
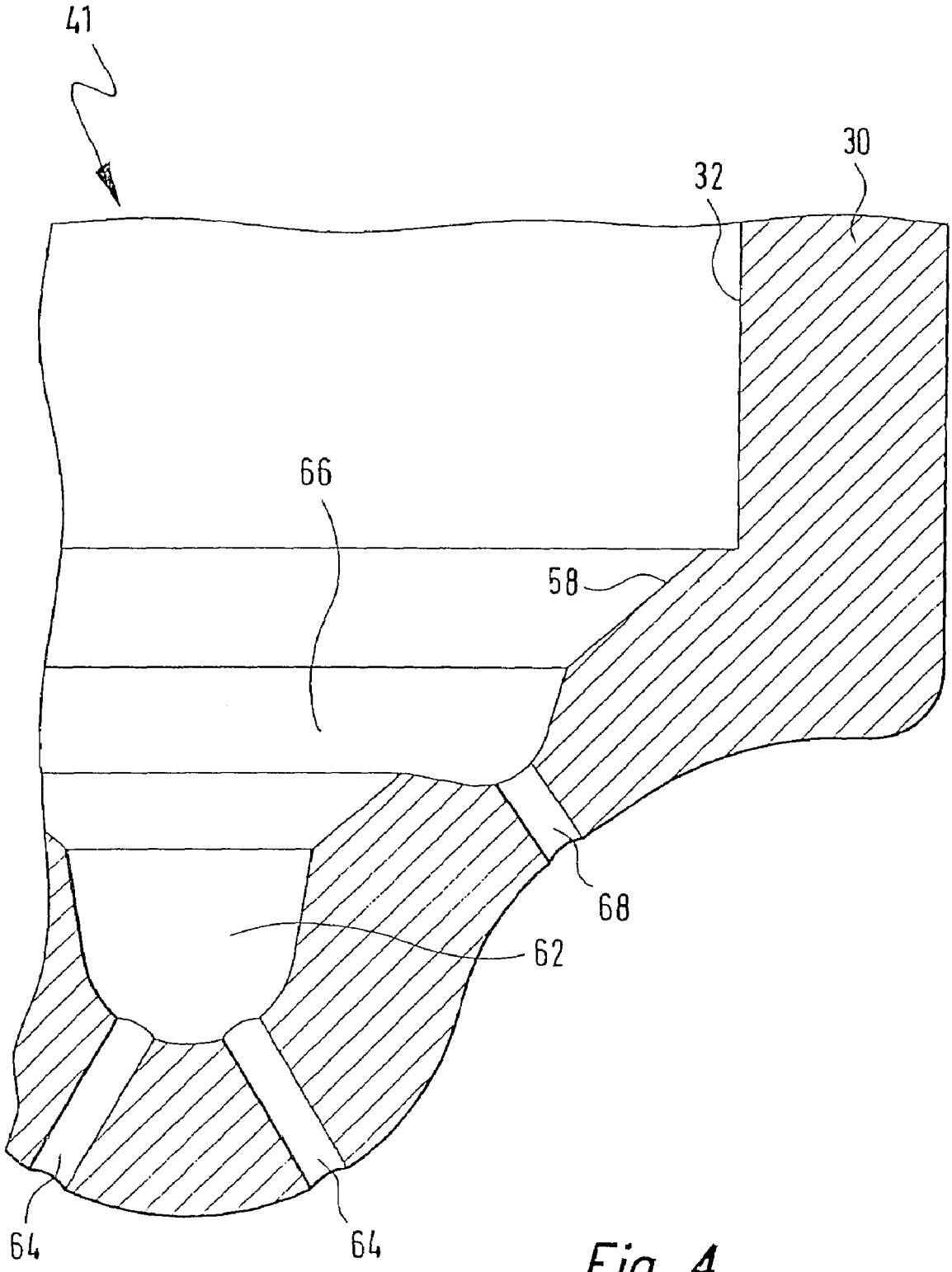
FIG. 4, a view similar to FIG. 3 of a modified exemplary embodiment of a fuel injection device.
Figure 5:
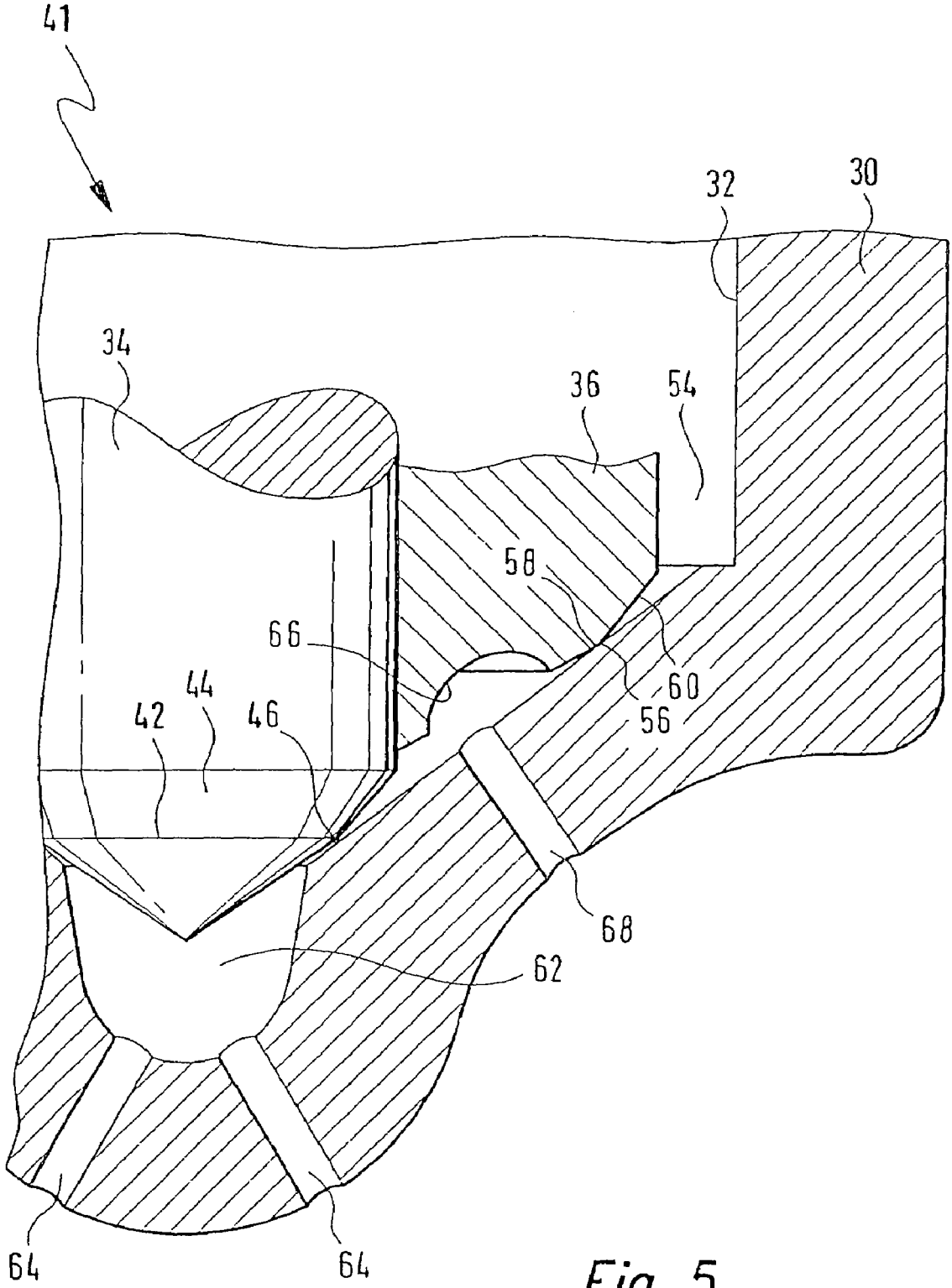
FIG. 5, a view similar to FIG. 3 of a further modified exemplary embodiment of a fuel injection device.

One possible variant of a fuel injection device 22 is shown in FIG. 5. In this drawing, those regions and elements that have equivalent functions to regions and elements in the exemplary embodiment shown in FIGS. 2 through 4 are identified by the same reference numerals and will not be described again here in detail.

The distinction between the fuel injection device 22 shown in FIG. 5 and the fuel injection device 22 shown in FIGS. 2 through 4 pertains to the position of the encompassing annular groove 66. In the embodiment shown in FIG. 5, this annular groove is not made in the inner wall of the recess 32 of the housing 30 but rather in the conical end face, located radially inward from the sealing edge 56, of the outer valve element 36.

Figure 6:
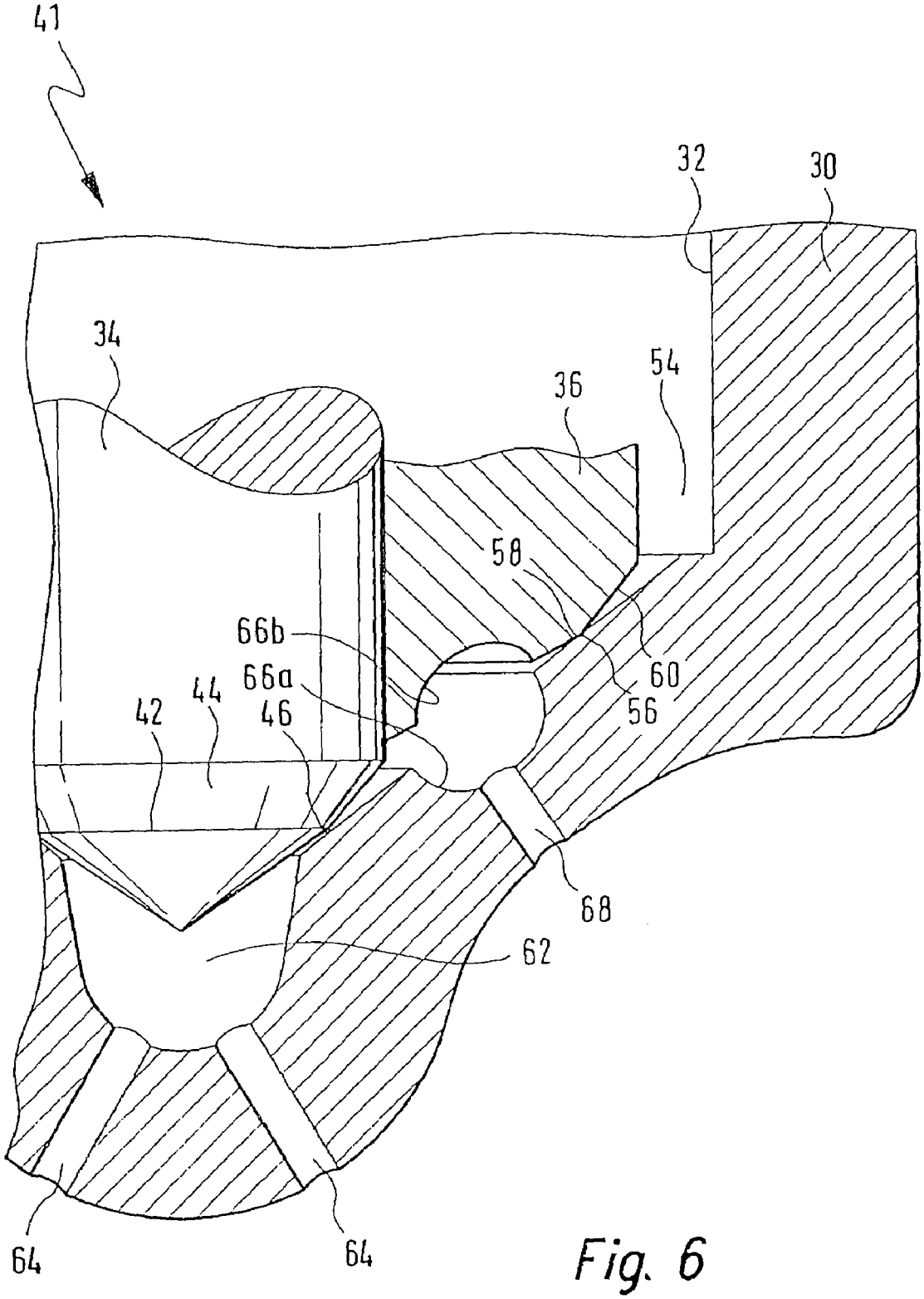
FIG. 6, a view similar to FIG. 3 of a further modified exemplary embodiment of a fuel injection device.

A further modified embodiment of a fuel injection device 22 is shown in FIG. 6. Once again, those elements and regions which are equivalent in function to elements and regions in FIGS. 2 through 5 have the same reference numerals and will not be explained again in detail.

In principle, the exemplary embodiment shown in FIG. 6 comprises a combination of the fuel injection device 22 of FIGS. 2 through 4 on the one hand and a fuel injection device 22 of FIG. 5 on the other: In the fuel injection device 22 shown in FIG. 6, there are in fact two encompassing annular grooves 66*a* and 66*b*; one is present in the inner wall of the recess 32 of the housing 30, while the other is conversely disposed in the conical face, located radially inward of the sealing edge 56, of the outer valve element 36. In this way, an annular chamber having a nearly circular cross section is created, from which the fuel outlet conduits 64 extend outward.

The foregoing relates to preferred exemplary embodiments of the invention, it being understood that other variants and embodiments thereof are possible within the spirit and scope of the invention, the latter being defined by the appended claims.

The invention claimed is:

1. A fuel injection device (22) for an internal combustion engine, comprising a housing (30), at least two coaxial valve elements (34, 36) which cooperate with respective valve seats (46, 58) on an injection end of the housing (30), at least two fuel outlet conduits (68) in the housing associated with each of the valve elements (34, 36), a first annular groove (66*a*) provided in the housing (30) for providing fluid communication between the fuel outlet conduits associated with the radially outer valve element, the fuel outlets (68) extending from this annular groove in a straight line from one end of each fuel outlet located at the first annular groove (66*a*) to an opposite end of each fuel outlet, and a second annular groove (66*b*) provided on the valve element for providing fluid communication between the fuel outlet conduits (68) associated with the radially outer valve element (36).

2. The fuel injection device (22) of claim 1, wherein the annular groove (66; 66*a*) is embodied in the housing (30).

3. The fuel injection device (22) of claim 2, wherein the annular groove (66) has an approximately semicircular cross section.

4. The fuel injection device (22) of claim 3, wherein the fuel outlet conduits (64) of the radially inner valve element (34) begin at a central blind hole (62) which is formed on the injection end of the housing (30).

5. The fuel injection device (22) of claim 2, wherein the annular groove has an asymmetrical cross section, with a lesser total curvature upstream of the fuel outlet conduits than downstream.

6. The fuel injection device (22) of claim 5, wherein the fuel outlet conduits (64) of the radially inner valve element (34) begin at a central blind hole (62) which is formed on the injection end of the housing (30).

7. The fuel injection device (22) of claim 2, wherein the fuel outlet conduits (64) of the radially inner valve element (34) begin at a central blind hole (62) which is formed on the injection end of the housing (30).

8. The fuel injection device (22) of claim 1, wherein the annular groove (66; 66*b*) is embodied in the valve element (36).

9. The fuel injection device (22) of claim 8, wherein the annular groove (66) has an approximately semicircular cross section.

10. The fuel injection device (22) of claim 8, wherein the annular groove has an asymmetrical cross section, with a lesser total curvature upstream of the fuel outlet conduits than downstream.

11. The fuel injection device (22) of claim 10, wherein the fuel outlet conduits (64) of the radially inner valve element (34) begin at a central blind hole (62) which is formed on the injection end of the housing (30).

12. The fuel injection device (22) of claim 8, wherein the fuel outlet conduits (64) of the radially inner valve element (34) begin at a central blind hole (62) which is formed on the injection end of the housing (30).

13. The fuel injection device (22) of claim 1, wherein the annular groove (66) comprises one annular groove (66*a*) embodied in the housing (30), and a further annular groove (66*b*) embodied in the valve element (36).

14. The fuel injection device (22) of claim 13, wherein the annular groove (66) has an approximately semicircular cross section.

15. The fuel injection device (22) of claim 13, wherein the fuel outlet conduits (64) of the radially inner valve element (34) begin at a central blind hole (62) which is formed on the injection end of the housing (30).

16. The fuel injection device (22) of claim 1, wherein the annular groove (66) has an approximately semicircular cross section.

17. The fuel injection device (22) of claim 16, wherein the fuel outlet conduits (64) of the radially inner valve element (34) begin at a central blind hole (62) which is formed on the injection end of the housing (30).

18. The fuel injection device (22) of claim 1, wherein the annular groove has an asymmetrical cross section, with a lesser total curvature upstream of the fuel outlet conduits than downstream.

19. The fuel injection device (22) of claim 18, wherein the fuel outlet conduits (64) of the radially inner valve element (34) begin at a central blind hole (62) which is formed on the injection end of the housing (30).

20. The fuel injection device (22) of claim 1, wherein the fuel outlet conduits (64) of the radially inner valve element (34) begin at a central blind hole (62) which is formed on the injection end of the housing (30).

* * * * *